United States Patent [19]

Craft

[11] 4,353,658

[45] Oct. 12, 1982

[54] RIBBON FEED MODE SHIFT MECHANISM

[75] Inventor: James A. Craft, Lexington, Ky.

[73] Assignee: International Business Machines Corporation, Armonk, N.Y.

[21] Appl. No.: 270,475

[22] Filed: Jun. 4, 1981

[51] Int. Cl.[3] ..... B41J 33/22; B41J 33/38

[52] U.S. Cl. ..... 400/232; 400/208; 400/227.2; 400/236.2

[58] Field of Search ..... 400/227.2, 232, 236.2, 400/196.1, 208; 226/40

[56] References Cited

U.S. PATENT DOCUMENTS 3,604,549 9/1971 Caudill et al. ..... 400/227.2 X
3,731,781 5/1973 Caudill et al. ..... 400/232
3,976,183 8/1976 Fleischmann et al. ..... 400/227.2 X
4,231,667 11/1980 Behrendt et al. ..... 400/227.2 X

*Primary Examiner*—Clifford D. Crowder
*Assistant Examiner*—Charles A. Pearson
*Attorney, Agent, or Firm*—John A. Brady

[57] ABSTRACT

Leaf spring (20) is overcome by a coil spring (15) when a cartridge cylinder (42) is not in place. In that status bottom gear (11) is engaged with bottom gear (17) so that movement from shaft (1) produces long ribbon feed. When a cartridge (40) is mounted having a cylinder (42) adapted to squeeze the spring (20), the force of coil spring (15) is overcome, and top gear (9) engages top gear (16), producing short ribbon feed.

7 Claims, 5 Drawing Figures

RIBBON FEED MODE SHIFT MECHANISM

DESCRIPTION

1. Technical Field

This invention relates to typewriters and other printers in which the mode of ribbon feed is changed in response to the form of the ribbon cartridge loaded on the machine. The individual ribbon cartridges typically may carry either a ribbon which must be used without overstrike or a ribbon intended to be used with overstrike. The feed mechanism of the typewriter is changed accordingly.

2. Background Art

The gear train with which the preferred embodiment of this invention interacts is identical to that on typewriters previously sold for years in large numbers by the assignee of this invention. Also, the configurations on the ribbon cartridges which interact with the novel mode change mechanism of this invention are identical to those which are used with those prior typewriters.

In the prior mode shift mechanism, top and bottom dishes are moveable along a shaft and are separated by a coil spring. Another spring under a bottom gear is dominant and forces an assembly of the bottom gear and a top gear upward. A cartridge carrying the kind of ribbon requiring the disengagement of the gears in the upward position has a downwardly depending cylinder. The end of the cylinder engages the top of the upper dish, which overcomes the lower spring and moves the gears downward as the cartridge is moved downward to its installed position.

In this prior assembly the lower spring continually applies an upward forces on the mounted cartridge through the end of the cylinder. The cartridge must be firmly held in place against this bias. Two yieldable detents positioned on each side of the cartridge enter indentations in the cartridge for this purpose. Noticeable manual force must be applied during installation of the cartridge since the detents are forced outward by the cartridge before ultimately springing into the holding position. Weakness or failure of the detents results in the cartridge moving from its required position.

DISCLOSURE OF THE INVENTION

In accordance with this invention the upper dish and the coil spring under that dish are eliminated, and a leaf spring is looped from the lower dish to a higher location on the shaft. The leaf spring is blocked from moving past the higher location and is free to move vertically along the post at the lower location. The bottom spring dominates the leaf spring so that, in the absence of external forces on the leaf spring, the gear assembly is forced upward and the leaf spring is bowed outward.

When a cartridge carrying a depending cylinder is being mounted for use, the sides of the cylinder encounter outwardly bowed parts of the leaf spring. These are forced downward, which overcomes the lower spring and thereby moves the gear assembly downward. As the cylinder moves downward, the leaf spring is forced into an elongated configuration in which it enters the cylinder.

The advantage of this configuration is that no final spring force is applied upward on the cartridge. The leaf spring forces are toward the cartridge sides. Yieldable detents as in the prior machine may be employed as a tactile indication to users that the cartridge is correctly positioned, but these can be lightly biased and their operation is not critical.

BRIEF DESCRIPTION OF THE DRAWINGS

The details of this invention will be described in connection with the accompanying drawings in which.

BEST MODE FOR CARRYING OUT THE INVENTION

Figure 1:
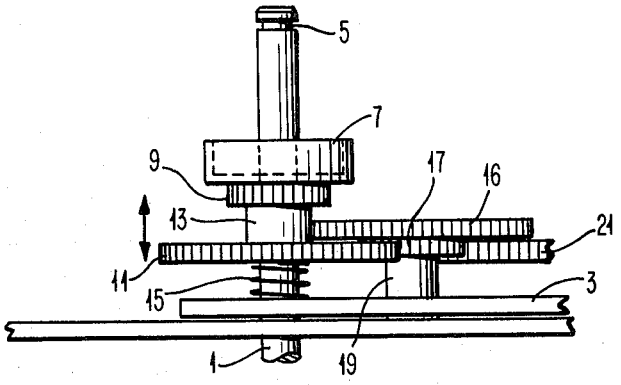
FIG. 1 PRIOR ART
FIG. 1 is a side view showing the prior art gear assembly elements and post.

The elements in FIG. 1 are those of the prior art, comprising a gear train and associated elements. The typewriter as a whole is merely suggested by a broken-out section of a plate under the gear train to be described. Input drive means and further gearing to ultimately drive the ribbon are not shown as the only elements shown are those closely related to this invention. Similarly, the upper dish and the coil spring between the upper dish and the lower dish 7 are not shown as these are elements of the prior art eliminated by this invention.

The typewriter effects ribbon feed by a mechanism which rotates shaft 1 the same amount for each typing operation. Shaft 1 passes rotatably through bottom plate 3 and extends upward, having a circular notch 5 near the top to receive a clip.

A dish 7 having an upper, concave surface is mounted on shaft 1 through a central hole permitting movement along shaft 1. A small gear 9 is located under dish 7 with shaft 1 passing through a central hole. A large gear 11, having a hub 13, which spaces it from gear 9, is likewise mounted on shaft 1. Shaft 1 and the gears 9 and 11 carry mating splines (not shown) so that movement of post 1 drives the gears 9 and 11.

A coil spring 15 on shaft 1 engages plate 3 and the bottom of gear 11. Spring 15 is normally effective to push the gears 9 and 11 upward to the position shown in FIG. 1.

The top gear 16 and bottom gear 17 are rotatably mounted on plate 3 at the fixed position above plate 3 set by the support member 19. Gears 16 and 17 are integral. Bottom gear 17 meshes with a gear 21 (partially shown), which translates the turning motion to ultimately feed ribbon.

In the position shown in FIG. 1 rotation of shaft 1 is translated by large gear 11 to small gear 17. This motion is translated to gear 21, ultimately to feed ribbon more than the width of one character for each character printed.

In the second position, dish 7 is pushed downward, thereby disengaging gear 11 and engaging small gear 9 with large gear 16. Since gears 16 and 17 are integral, motion from gear 9 is translated to gear 21 through gear 17 moving with gear 16. Because of the size ratio between gears 9 and 16, the ultimate ribbon feed is a small fraction of the width of one character for each character printed.

Figure 2:
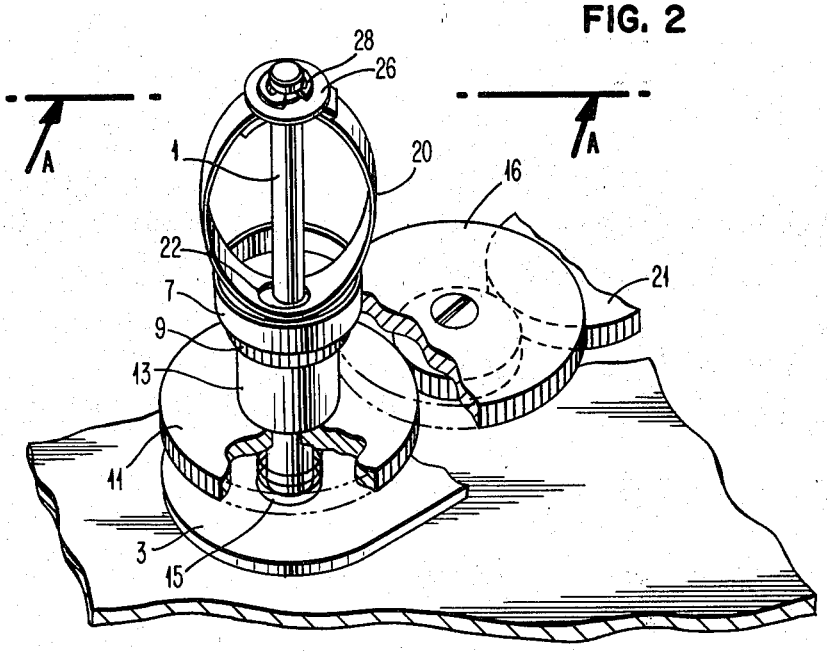
FIG. 2 is a perspective view of my invention installed with the gear assembly.

FIG. 2 illustrates a perspective view of the invention installed with the mechanism with which it directly interacts. The upwardly facing concave bottom of dish 7 receives a leaf spring 20 and spring 20 bows outward, through an elongated central hole 22 in spring 20.

Figure 3:
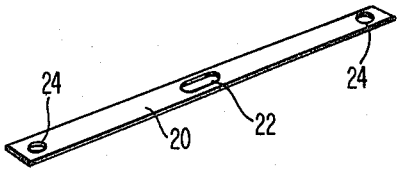
FIG. 3 is a perspective view of the leaf spring prior to its installation.

The leaf spring 20 prior to assembly is shown in FIG. 3. It is spring steel which has a flat configuration when untensioned. Central hole 22 and end holes 24 are each large enough to receive post 1. As shown in FIG. 2, the central hole 22 is positioned in dish 7. The spring 20 is bent upwardly on both sides and the holes 24 brought over shaft 1. The ends with holes 24 are deformed downwardly until they are under notch 5 (FIG. 1). A thin, flat washer member 26, having a central opening somewhat larger than shaft 1 is then positioned over shaft 1. Finally, a clip 28, of standard construction which yields outwardly when pressed into notch 5 is pushed into notch 5, until it fits around notch 5 and resiliently closes around notch 5 to hold the assembly of spring 20 and washer 26 against upward movement past clip 28.

Figure 4:
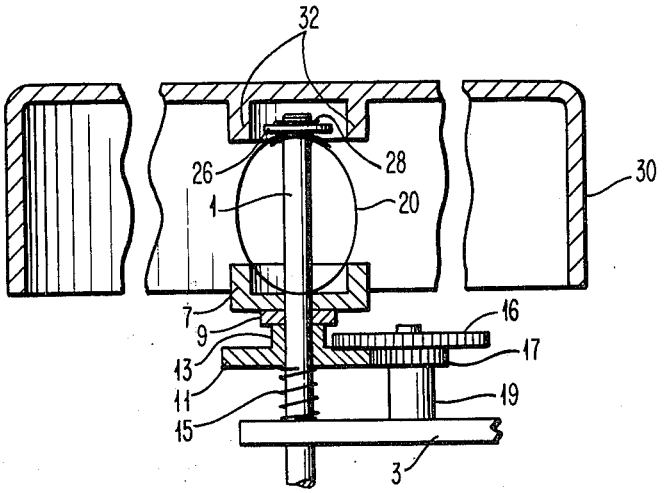
FIG. 4 is a side view through the plane A—A of FIG. 2, showing the physical configuration assumed when a cartridge is mounted having no depending cylinder of the type to which the invention is designed to respond.

FIG. 4 is a side view along the plane A—A of FIG. 2 and with spring 20 assumed to be in the angular position in which it is seen directly toward the thin edges. In use spring 20 is free to move angularly to any random position, and the angular position is not significant.

The cartridge 30 shown in cross-section in FIG. 4 contains a one-use ribbon, which is to be moved one third of the width of one character with each printing operation. The cartridge 30 has a stub cylinder 32, which is not long enough to engage spring 20 when the cartridge 30 is fully loaded. Spring 15 dominates spring 20, thereby moving the assembly of gears 11 and 9 and dish 7 upward. Gear 11 meshes with gear 17, and the resulting ratio is one to achieve the long ribbon feed movement required with each rotation of shaft 1 during printing.

Figure 5:
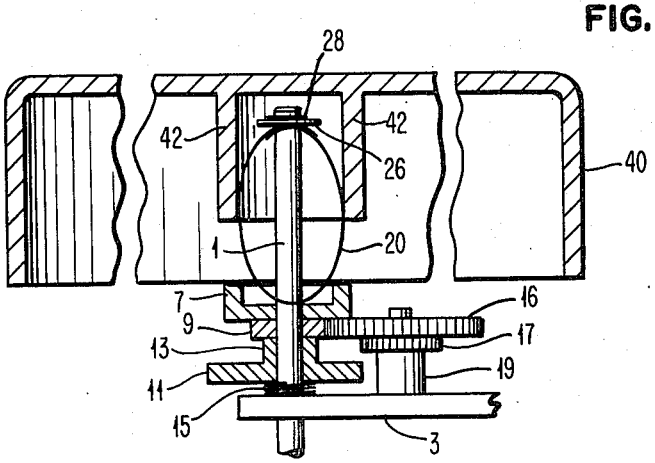
FIG. 5 is a side view through the plane A—A of FIG. 2, showing the physical configuration assumed when a cartridge is mounted having such a depending cylinder.

The cartridge 40 shown in cross-section in FIG. 5 contains a ribbon which is to be moved approximately one twentieth of one character width with each printing operation. As cartridge 40 is moved to the fully loaded position shown in FIG. 5, the sides of cylinder 42 form a cavity which engages leaf spring 20, which is bowed out under the influence of spring 15. This squeezes spring 20 inward, presenting a downward force which overcomes the upward force of spring 15. At the final position, dish 7 is pushed downward, which pushes gears 9 and 11 downward. At the fully loaded position, gear 11 is out of engagement and gear 9 meshes with gear 16. The resulting ratio produces the reduced feed movement to feed ribbon with each rotation of shaft 1 during printing, much less than when the gears are in the configuration of FIG. 3. Forces from spring 20 are applied to cartridge 40 where spring 20 engages the opposite sides of cylinder 42. The forces are oppositely directed forces from the opposite sides of spring 20. They are directed toward the sides of cartridge 40 and therefore do not tend to dislodge the cartridge.

It will be recognized that this invention can take various forms while still employing the bowed spring generally as described. In particular the spring can be in a fixed angular position or need not be a single member as shown. Accordingly, coverage should not be limited to the preferred embodiment shown, but should be as provided by law, with particular reference to the accompanying claims.

What is claimed is:

1. A ribbon feed mechanism having at least one gear mounted for longitudinal movement relative to a shaft, resilient means urging said at least one gear in one direction of longitudinal movement to one gear engagement position, and a leaf spring deformed to apply a force to said at least one gear opposite to the urging of said resilient means, a member stationary relative to said shaft, said leaf spring contacting said member, which member holds said leaf spring to apply the force of said leaf spring to said at least one gear said resilient means having sufficient force to overcome said leaf spring and cause it to bow outward, said leaf spring in said bowed condition being positioned so as to be contacted and deflected to a less bowed condition by a depending member mounted on a ribbon cartridge, the relative strengths of said leaf spring and said resilient means being selected so that when said leaf spring is in said bowed condition, it is displaced by said resilient means and when said leaf spring is in said less bowed condition it exerts a force sufficient to overcome said resilient means, deflection of said leaf spring to said less bowed condition resulting in movement of said at least one gear in the direction opposite said one direction to another gear engagement position.

2. The ribbon feed mechanism as in claim 1 in which said shaft is a central shaft and said leaf spring is mounted on said shaft with one part contacting said member to press said shaft and a part spaced from said one part mounted to move along said shaft while applying said force opposite the urging of said resilient means.

3. The ribbon feed mechanism as in claim 2 comprising a second gear mounted spaced from said one gear and mounted for said longitudinal movement and in which said gears are meshed to said shaft for rotation with said shaft and said leaf spring is mounted on a member having a central hole passing through said shaft.

4. The ribbon feed mechanism as in claim 3 in which said leaf spring is a single element having a central hole mounted over said shaft and two end holes mounted over said shaft and held from movement off said shaft by a clip mounted in the way of movement of said leaf spring ends away from said central hole.

5. The ribbon feed mechanism as in claim 4 in which said leaf spring is mounted on a member having a surface facing said clip.

6. The ribbon feed mechanism as recited in any one of claims 1,2,3,4 or 5, further comprising, in combination with said ribbon feed mechanism, a cartridge containing a transfer medium to be moved past printing positions by said ribbon feed mechanism, said cartridge having an internal part defining a leaf spring receiving cavity, said ribbon feed mechanism having a leaf spring normally deformed to a dimension greater than the diameter of said cavity, said cavity, upon being engaged with said ribbon feed mechanism, squeezing said leaf spring to contract to a dimension to fit within said cavity, the change in the dimension of said leaf spring effecting a change in the ribbon feed mode of said mechanism by elongation of said leaf spring while said leaf spring produces substantially no forces tending to disengage said cartridge from said ribbon feed mechanism.

7. A combined ribbon feed mechanism and cartridge comprising a cartridge containing a transfer medium to be moved past printing positions by said ribbon feed mechanism, said cartridge having an internal part defining a leaf spring receiving cavity opposite, spaced sides, said ribbon feed mechanism having a leaf spring normally deformed to a dimension greater than the diameter of said cavity, said cavity, upon being engaged with said ribbon feed mechanism, squeezing said leaf spring to contract to a dimension to fit within said cavity, the change in dimension of said leaf spring effecting a change in the ribbon feed mode of said mechanism by elongation of said leaf spring while said leaf spring produces substantially no forces tending to disengage said cartridge from said ribbon feed mechanism.

* * * * *